United States Patent [19]

Bondon

[11] Patent Number: 4,705,914

[45] Date of Patent: Nov. 10, 1987

[54] HIGH VOLTAGE FLEXIBLE CABLE FOR PRESSURIZED GAS INSULATED TRANSMISSION LINE

[76] Inventor: Lewis A. Bondon, 167 Highland Ave., Montclair, N.J. 07042

[21] Appl. No.: 928,699

[22] Filed: Nov. 10, 1986

Related U.S. Application Data

[63] Continuation of Ser. No. 788,980, Oct. 18, 1985, abandoned.

[51] Int. Cl.[4] ..... H01B 9/06

[52] U.S. Cl. ..... 174/28; 174/29

[58] Field of Search ..... 174/28, 29

[56] References Cited

U.S. PATENT DOCUMENTS

| | | | |
|---|---|---|---|
| 2,488,211 | 11/1949 | Lemon | 174/28 |
| 2,556,244 | 6/1951 | Weston | 174/29 |
| 2,998,472 | 8/1961 | Bondon | 174/28 |
| 3,055,967 | 9/1962 | Bondon | 174/28 |
| 3,121,136 | 2/1964 | Mildner | 174/28 |
| 3,831,636 | 8/1974 | Bittner | 174/28 X |
| 4,092,485 | 5/1978 | Wanser | 174/28 |
| 4,132,855 | 1/1979 | Clark et al. | 174/28 |

FOREIGN PATENT DOCUMENTS

| | | | |
|---|---|---|---|
| 1479424 | 3/1967 | France | 174/28 |
| 1068970 | 5/1967 | United Kingdom | 174/28 |

*Primary Examiner*—Morris H. Nimmo

*Attorney, Agent, or Firm*—Hopgood, Calimafde, Kalil, Blaustein & Judlowe

[57] ABSTRACT

A high voltage flexible cable for pressurized gas insulated transmission line service has a continuous gas-tight cylindrical metallic conductive sheath corrugated circumferentially throughout its length. An elongated coextensive conductor member having an outer surface corrugated circumferentially throughout its length is disposed within the metallic sheath and separated from the sheath by a plurality of tubular elements of electrically insulating material disposed lengthwise of the cable in a transversely packed circumferential array around the conductor member between the sheath and the conductor member. The tubular elements are contacted throughout their length at least by the roots of the sheath corrugations and the crests of the conductor member corrugations that sufficiently indent the tubular elements radially of the cable to interlock the tubular elements with both the conductor member and the sheath to resist relative longitudal movement between the tubular elements and both the sheath and the conductor member. The tubular elements are dimensioned in cross section and deformed radially of the cable such that adjacent tubular elements circumferentially around the conductor member are in forceful surface contact to prevent particulate migration in the cable radial direction. The conductor member can be formed from a corrugated tube filled with wire conductors. Alternatively the conductor member can include two radially spaced apart concentric corrugated metallic tubes between which are disposed flat wires either tightly or loosely arranged or helically disposed.

9 Claims, 6 Drawing Figures

HIGH VOLTAGE FLEXIBLE CABLE FOR PRESSURIZED GAS INSULATED TRANSMISSION LINE

This application is a continuation, of application Ser. No. 788,980, filed Oct. 18, 1985 now abandoned.

BACKGROUND OF THE INVENTION

The present invention relates to high voltage flexible transmission lines and, more particularly, to the class of transmission lines referred to in the industry as gas insulated transmission lines or by the initials GITL.

For many years the United States Department of Energy and the Electric Power Research Institute, Inc. (EPRI) have been sponsoring research to develop high voltage transmission system cables. One type of cable has a rigid metal sheath and employs an electronegative gas under pressure as the primary insulation. These cables are now generally designated, as noted above, by the initials GITL. Gases such as $SF_6$ (sulfur hexafluoride) are used to increase the high voltage breakdown levels of these GITL cables. Research has been going on for at least ten years. A paper entitled "Installation and Field Testing of 138 kv $SF_6$ Gas Insulated Station and Transmission Line" by T. F. Garrity, R. Matulic and G. Rhodes, was presented at the IEEE PES winter meeting in New York on Jan. 1–31, 1975. This paper contains, inter alia, six references to additional articles concerning the subject.

Rigid lines pressurized with gas as insulation have been produced and used, but because of the rigid character they must be prefabricated in relatively short lengths, generally no more than 60 feet, on a custom basis and have been used primarily in power stations. These cables employ either dielectric disc or post-type insulator supports for aligning the inner conductor element in appropriate relationship to an outer metallic tube element usually referred to as the sheath. The conductor element which is the current carrying member of the cable, as well as the sheath member, are usually fabricated from copper or aluminum. The conductor and sheath are held in concentric alignment by means of the insulating dielectric spacers which may be molded or vacuum cast from an organic or inorganic material such as an alumina-filled epoxy resin. Upon installation the space between the sheath and the conductor is then filled with a compressed gas such as $SF_6$ which under operating conditions may be at a typical pressure of 50 p.s.i.g. at temperatures up to 150° C. The problems encountered with such cable systems are considerable.

For example, in order to provide the necessary dielectric strength to withstand the high voltages, the rigid line sections, prior to operation, are normally purged or cleaned in an attempt to remove microscopic particles of metal which remain in the cable after construction is completed. However, complete elimination of the metal particles is impossible and during cable operation the metal particles remaining in the cable tend to migrate or oscillate between the conductor and sheath due to the highly stressed electric and magnetic fields. Movement of the remaining particles between the conductor and sheath can cause voltage breakdown. Prior art GITL systems have employed particle traps and other additional components in an effort to capture these particles before damage is done.

A major problem encountered in attempting to design transmission lines of the foregoing type for long runs when the line is intended to carry high currents is that resulting from differential thermal expansion. Because of the high voltages the conductor and shield must have significantly different diameters in order to provide an adequate gap therebetween, and when this gap is filled with an electrically insulating material, whether it be fluid or solid, such material also introduces thermal insulation. Consequently, a significant thermal gradient develops between the conductor and the sheath. The conductor tends to want to elongate as the temperature rises, and being at a higher temperature than the sheath, expands longitudinally relative thereto. However, if the ends of the cable are restrained at the respective terminations, the strain developed in the conductor must be accommodated in some manner and this produces extreme mechanical forces as the conductor tends to distort within the confines of the sheath. This can result in destruction of the spacers and/or failure of terminal connectors.

In my U.S. Pat. No. 2,998,472 issued Aug. 29, 1961 for "Insulated Electrical Conductor and Method of Manufacture" I disclosed a coaxial cable construction with two or more conductors intended primarily for radio frequency service. The cable contained an array of insulating tubes laid about a conductor and pressed into contact with the conductor to form a symmetrical array wherein the insulating cross-section provided a maximal amount of space and a minimal amount of dielectric mass. To construct the cable the insulating tubing was assembled in a loose array about the conductor. The insulating tubing and conductor or conductors were then drawn into a uniform diameter jacket of metal, organic material or other semi-rigid material which was thereafter drawn or otherwise reduced in size to cause the insulating tubes and conductors to be tightly packed into an array of the desired configuration. As a result the insulating tubing and the conductors were immovably secured against lateral movement in a predetermined configuration within the jacket, namely, with the conductor centered within the jacket.

It was suggested in my said patent that the jacket might be a wound armoured type such as that utilized in the familiar "BX cable", or it might take the form of round wire or flat wire braiding. However, in all instances the cables were intended for communication service, it being contemplated that they would generally be utilized for the transmission of audio frequency or radio frequency signals. Such service, particularly where both the inner and outer conductive elements were carrying current, did not produce severe thermal problems. Under such circumstance the frictional engagement between conductor, insulator tubes and jacket was adequate to restrict relative longitudinal movement to a minimum.

Another United States patent dealing with radio frequency cables was issued Feb. 11, 1964 under U.S. Pat. No. 3,121,136 to Mildner, entitled "Co-Axial Cable Having Inner and Outer Conductors Corrugated Helically in Opposite Directions". According to said patent "there is provided an air-spaced co-axial cable comprising an inner tubular corrugated conductor, an outer tubular corrugated conductor, at least one of the conductors being helically corrugated, and insulating material affording air spaces extending between the conductors longitudinally of the cable, the insulation material engaging against the crests of the corrugations on the inner conductor and against the troughs of the corrugations on the outer conductor."

While thermal problems must be considered when constructing coaxial cables for communication service, such as the cables contemplated by both my above-mentioned prior patent and the Mildner patent, such thermal problems are comparatively insignificant when compared with the thermal problems encountered in high voltage power transmission lines. Seeking maximum efficiency, electric power is transmitted at high voltage so as to reduce the current for a given power quantity. Nevertheless, power transmission involves very large currents which, within practical limits of conductor "copper", produce considerable heat. This heat is generated within the conductor. Since the conductor is separated by insulation from the outer sheath, and since such insulation not only insulates against electric current but also against caloric transmission, a considerable thermal gradient develops radially in the power cable. Naturally, this creates serious physical problems due to differing coefficients of thermal expansion characterizing the various materials making up a given cable. The problems arising from differential thermal expansion are exacerbated when attempts are made to produce long flexible lengths of cable suitable for high voltage power transmission service.

SUMMARY OF THE PRESENT INVENTION

An object of the present invention is to provide a high voltage flexible cable for pressurized gas insulated transmission line service that is economical to fabricate and overcomes the problems heretofore encountered with rigid metal tubular sheath embodiments of existing gas insulated lines.

A further object of the present invention is to provide a GITL cable that is flexible and can be used over long spans immune to destruction arising from differential longitudinal expansion effects on cable components.

In accordance with the invention there is provided a high voltage flexible cable for pressurized gas insulated transmission line service comprising in combination a continuous gas-tight cylindrical metallic conductive sheath corrugated circumferentially throughout its length, at least one elongated coextensive conductor member having an outer surface corrugated circumferentially throughout its length, and a plurality of tubular elements of electrically insulating material disposed lengthwise of the cable in a transversely packed circumferential array around said conductor member between said sheath and said conductor member, said tubular elements being contacted throughout their length at least by the roots of the sheath corrugations and the crests of the conductor member corrugations and being sufficiently indented radially of the cable where they contact said roots of the corrugations of the sheath and said crests of the corrugations of the conductor member to become interlocked to resist relative longitudinal movement between said tubular elements and both said sheath and said conductor member, and said tubular elements being dimensioned in cross section and deformed radially of said cable such that adjacent tubular elements circumferentially around the conductor member are in forceful surface contact to prevent particulate migration in the cable radial direction during cable use.

BRIEF DESCRIPTION OF THE DRAWINGS

The invention will be better understood after reading the following detailed description of the presently preferred embodiments of the invention with reference to the appended drawings in which.

The same reference numerals are used throughout the drawings to designate the same or similar parts.

DETAILED DESCRIPTION OF THE PRESENTLY PREFERRED EMBODIMENTS

Figure 1:
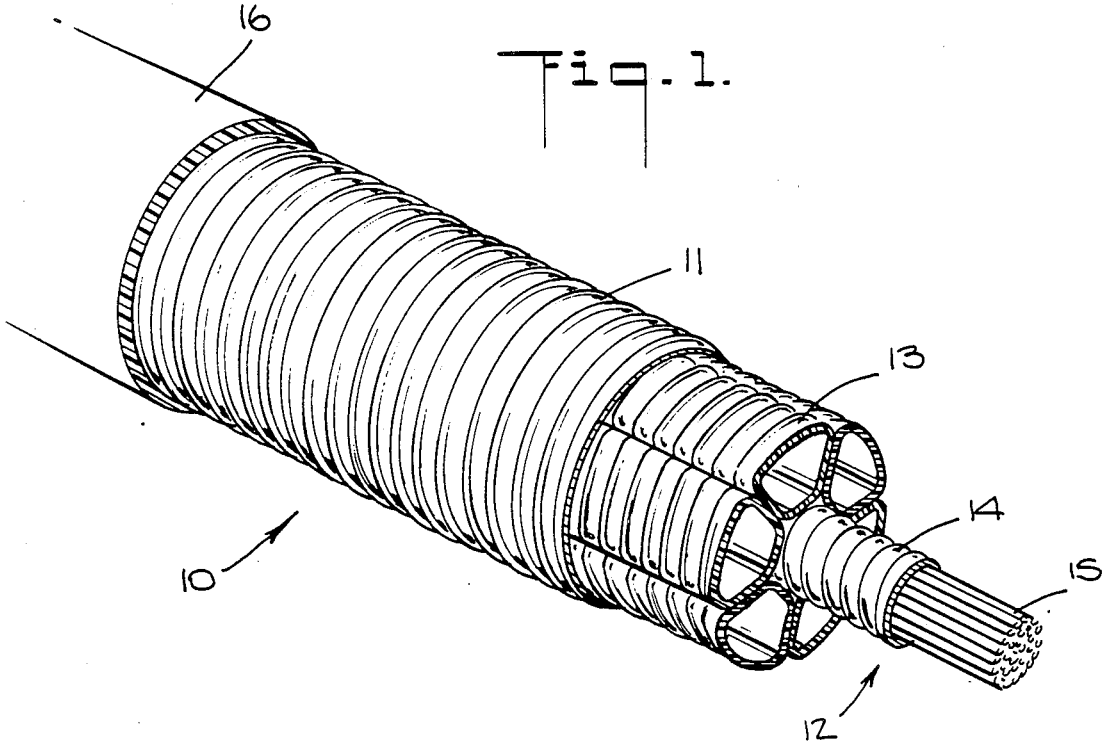
FIG. 1 is a perspective view with the various layers cut away to show the construction of a cable embodying the present invention.

Referring to FIG. 1, there is shown a cable section embodying the present invention and designated generally by the numeral 10. The cable 10 includes a gas-tight cylindrical metallic conductive sheath 11 of copper, aluminum or other suitable material, corrugated circumferentially throughout the length of the cable. An elongated coextensive conductor member, designated generally by the numeral 12, having an outer surface corrugated circumferentially throughout its length, is disposed coaxially within the sheath 11 and spaced from the latter by a plurality of tubular elements 13 of electrically insulating material disposed lengthwise of the cable in a transversely packed circumferential array around the conductor member 12 between the sheath 11 and the conductor member 12. The tubular elements are contacted throughout their length at least by the roots of the sheath 11 corrugations and the crests of the conductor member 12 corrugations. However, unlike the prior art cables, the tubular elements here are sufficiently indented radially of the cable where they contact the roots of the corrugations of the sheath 11 and the crests of the corrugations of the conductor member to become interlocked to resist relative longitudinal movement between the elements 13 and both the sheath 11 and conductor 12. The tubular elements 13 are dimensioned in cross section and deformed radially of the cable such that adjacent tubular elements circumferentially around the conductor member 12 are in forceful surface contact to prevent particulate migration in the cable radial direction during cable use.

In the cable the tubular elements 13 have a cross-section that resembles a trapezoid and are substantially equal-dimensioned in the transverse direction. The height or altitude of the trapezoid is oriented generally radially of the cable and is at least 0.5% less than the original diameter of the tubular element 13 when the latter is unconfined. This is to ensure adequate interlocking between the component parts of the cable, as mentioned above. Regardless of the relationship of the corrugations of the sheath 11 relative to the corrugations of the outer surface of the conductor 12, the transverse profile of the tubular elements 13 will vary along the length of the tubular elements depending upon the relation to the crests and roots, respectively, of the conductor member 12 and sheath 11. At the points of maximum radial indentation of the tubular elements 13, the height of the trapezoid at that point is preferably within the range of 10% to 15% smaller than the original unconfined tubular diameter.

As shown in FIG. 1, the conductor 12 includes a corrugated metallic tube 14 within which is disposed a bundle of electrically conductive wires 15. The wires 15 are preferably loosely laid lengthwise or helical-wise within the tube 14. This contributes to the cable flexibility. More important, however, is the ability of the wires 15 to distort, i.e., assume an undulatory condition, in the presence of elevated temperatures thereby accommodating thermal expansion even though opposite ends may be fixed in place by end terminations. Of course, the corrugated tube 14 can accommodate longitudinal elongation through accordian action, any increase in diameter being absorbed by further deformation of the tubular elements 13.

When installed, all of the free space throughout the cable would normally be filled with an electronegative gas under pressure. Sulfur hexafluoride ($SF_6$) is a typical gas known for this purpose. The pressure is not so great, however, as to preclude compression to absorb the thermal expansion activity mentioned above.

If desired, additional tubular or other compressible insulation can be included along with the wires 15 within the conductor tube 14. When the conductor center is filled with pressurized gas, the gas and compressible insulation (not shown) will function to accommodate thermal expansion and contraction effects in a manner similar to the outer insulator tubes 13.

While not illustrated, a thin wall coating of insulating material can be extruded, if desired, over the corrugated tube 14 so long as the coating conforms to the corrugations and does not prevent satisfactory interlocking engagement with the tubular elements 13.

To complete the cable 10, an outer jacket 16 of a suitable protective material such as high density polyethylene can be extruded over the sheath 11.

Figure 2:
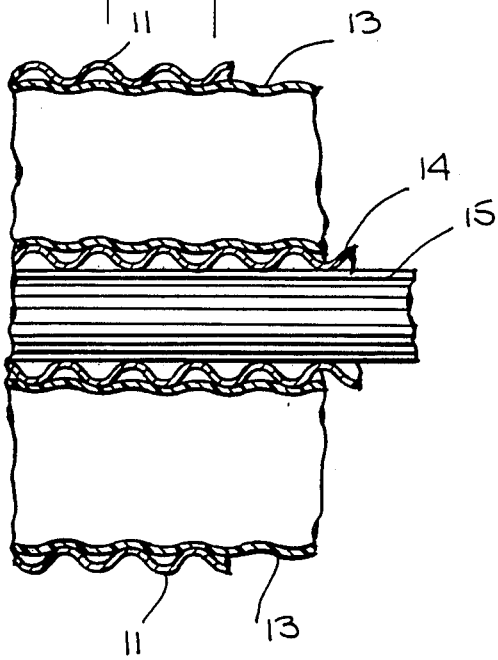
FIG. 2 is a fragmentary longitudinal sectional view of a cable of the general type shown in FIG. 1, but illustrating a particular relationship between the corrugation of a conductor element and the corrugations of the sheath.

Referring to FIG. 2, there is illustrated by way of example a construction wherein the roots of the corrugations of the sheath 11 lie in a common plane with the roots of the corrugations in the tube 14. An alternative construction is shown in FIG. 3 wherein one course of corrugations is shifted 180° in phase relative to the other course such that the roots of sheath 11 now lie opposite the crests of the corrugations of tube 14.

Figure 3:
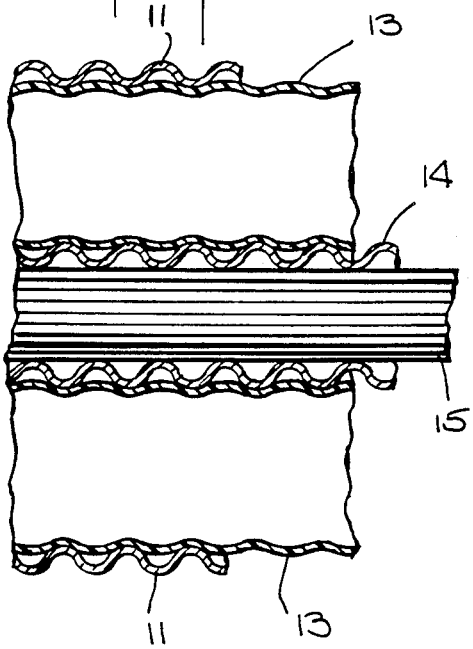
FIG. 3 is a view similar to FIG. 2 but showing a modification thereof.

FIGS. 2 and 3 illustrate two of an infinite variety of inter-corrugation relationships that can be utilized. The corrugations can be annular or helical. They can be of the same hand or opposite hand. And they can be of equal or different pitch. Choice of the corrugations will depend on the flexibility desired for the cable and possibly other considerations such as the degree of interlock required between metal and dielectric.

Figure 4:
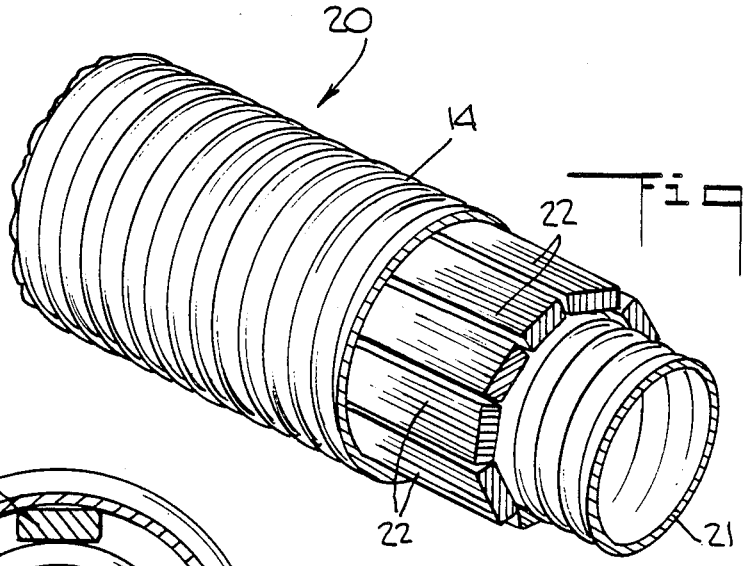
FIG. 4 is a perspective view with layers cut away showing a modified conductor for use in the cable of FIG. 1.

Instead of obtaining the required ampacity by adding "copper" within the tube 14, the conductor can be constructed with a hollow core or center as shown in FIG. 4. As illustrated therein, the conductor, designated generally by the numeral 20, consists of an additional tube 21 of corrugated electrically conductive material such as copper disposed concentrically within the outer corrugated conductor tube 14. The corrugated tubes 14 and 21 are of different diameters so as to define a gap between the outer surface of the crests of the corrugations of the radially inner tube 21 and the inner surface of the roots of the corrugations of the radially outer tube 14. To make up the necessary "copper" as called for by the desired cable ampacity, a plurality of electrical conductor wires 22 are disposed longitudinally of the cable within the gap just mentioned between tubes 14 and 21. As shown in FIG. 4, the wires 22 are flat wires although round wires could be used, if desired. The wires 22 are closely arrayed within the inter-tubular gap. Again, the space, both within the inner tube 21 and between the arrayed wires 22, can be filled with pressurized dielectric gas upon cable installation. Also the outer surface of the conductor tube 14 can be coated with a suitable thin layer of insulative material.

It should be understood that the conductor 20 can be substituted for the conductor 12 in the cable described with reference to FIGS. 1 to 3. Because the conductor 20 is hollow a coolant can be circulated therethrough in order to limit the temperature rise and, consequently, the thermal expansion effects. Hence, it is possible to fill the gap between tubes 14 and 21 with wire without fear of cable damage arising out of the thermal expansion characteristics.

Figure 5:
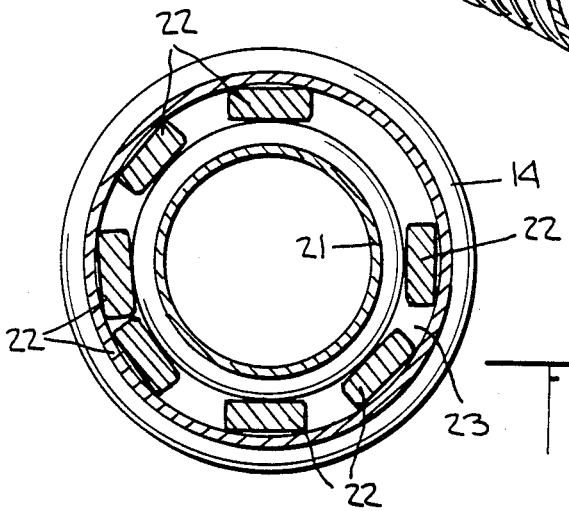
FIG. 5 is a transverse sectional view of a cable conductor similar to that shown in FIG. 4 but embodying a modification thereof.

If the thermal effects can not be minimized by coolant circulation for any reason, resort can be had to the modification illustrated in FIG. 5 wherein the flat wires 22 are loosely disposed within the gap 23 between corrugated tubes 14 and 21. The loose arrangement allows the wires 22 to distort circumferentially of the cable for the purpose of accommodating thermal expansion. In all other respects the conductor of FIG. 5 can be the same as that of FIG. 4.

Figure 6:
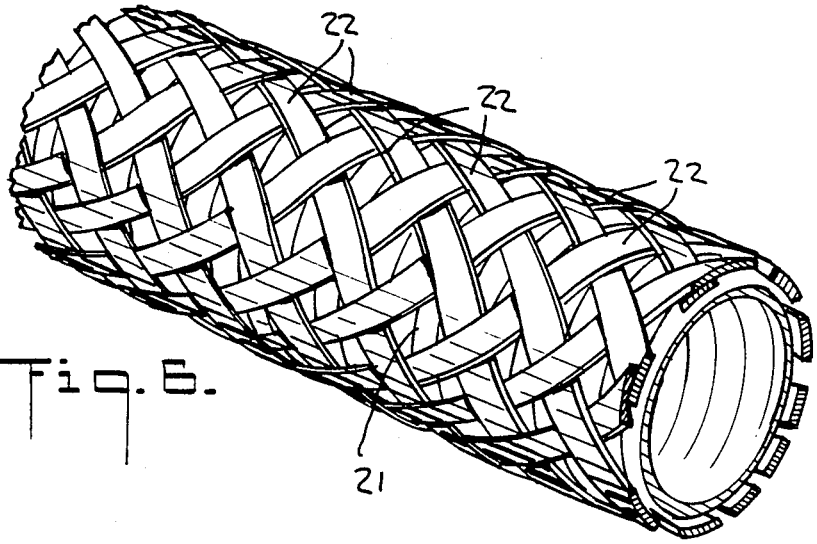
FIG. 6 is a perspective view of the radially inner portion of a conductor similar to the corresponding portions shown in FIGS. 4 and 5, but illustrating a modification wherein the flat wires are helically disposed.

Various other possibilities exist to increase the flexibility of the cable while achieving high ampacity. For example, flat wires can be braided about the inner corrugated tube 21 as shown in FIG. 6 rather than being laid straight. The assembly shown in FIG. 6 can then be enclosed within a snug fitting corrugated metal tube such as the tube 14 shown in FIGS. 4 and 5.

Wherever "copper" has been mentioned throughout the specification it will be appreciated that other conductive materials such as aluminum can be used instead.

Having described the subject invention with reference to the presently preferred embodiments thereof, it will be understood by those skilled in the subject art that various changes in construction can be introduced without departing from the true spirit of the invention as defined in the appended claims.

What is claimed is:

1. A high voltage flexible cable for pressurized gas insulated transmission line service comprising in combination a continuous gas-tight cylindrical metallic conductive sheath corrugated circumferentially throughout its length, at least one elongated coextensive conductor member disposed within said sheath and having an outer surface corrugated circumferentially throughout its length, and a plurality of tubular elements of electrically insulating material disposed lengthwise of the cable in a transversely packed circumferential array around said conductor member between said sheath and said conductor member, said tubular elements throughout their length being squeezed radially of the cable between said sheath and said conductor member with the roots of said sheath corrugations and the crests of said conductor member corrugations radially indenting said tubular elements at axially spaced intervals sufficient to interlock said tubular elements with both said sheath and said conductor member to resist relative longitudinal movement between said tubular elements and both said sheath and said conductor member, and said tubular elements being dimensioned in cross section and deformed radially of said cable such that adjacent tubular elements circuferentially around the conductor member are in forceful surface contact to prevent particulate migration in the cable radial direction during cable use.

2. A high voltage flexible cable for pressurized gas insulated transmission line service according to claim 1, wherein said tubular elements in said cable are roughly trapezoidal and substantially equal-dimensioned in the transverse direction with the trapezoidal height oriented generally radially of the cable and being at least 0.5% less than the original diameter of the tubular element when unconfined.

3. A high voltage flexible cable for pressurized gas insulated transmission line service according to claim 2, wherein the transverse profile of said tubular elements varies along the length of said tubular elements accompanied by radial indentation that varies in the axial direction depending upon the relation to said crests and roots, respectively, of said conductor member and said sheath, and at the points of maximum radial indentation of said tubular elements said trapezoidal heights are within the range of 10% to 15% smaller than said original unconfined tubular element diameters.

4. A high voltage flexible cable for pressurized gas insulated transmission line service according to claim 1, wherein said conductor member comprises a plurality of conductor wires disposed loosely within a corrugated tube of electrically conductive material.

5. A high voltage flexible cable for pressurized gas insulated transmission line service comprising in combination a continuous gas-tight cylindrical metallic conductive sheath corrugated circumferentially throughout its length, at least one elongated coextensive conductor member disposed within said sheath and having an outer surface corrugated circumferentially throughout its length, said conductor member comprising two concentric corrugated tubes of electrically conductive material of different diameters with a gap between the outer surface of the crests of the corrugations of the radially inner conductor tube and the inner surface of the roots of the corrugations of the radially outer conductor tube, a plurality of electrical conductor wires disposed loosely longitudinally of the cable within said gap, and a plurality of tubular elements of electrically insulating material disposed lengthwise of the cable in a transversely packed circumferential array around said conductor member between said sheath and said conductor member, said tubular elements being contacted throughout their length at least by the roots of the sheath corrugations and the crests of the conductor member corrugations and being sufficiently indented radially of the cable where they contact said roots of the corrugations of the sheath and said crests of the corrugations of the conductor member to become interlocked to resist relative longitudinal movement between said tubular elements and both said sheath and said conductor member, and said tubular elements being dimensioned in cross section and deformed radially of said cable such that adjacent tubular elements circumferentially around the conductor member are in forceful surface contact to prevent particulate migration in the cable radial direction during cable use.

6. A high voltage flexible cable for pressurized gas insulated transmission line service according to claim 5, wherein said electrical conductor wires are flat wires.

7. A high voltage flexible cable for pressurized gas insulated transmission line service according to claim 6, wherein said flat wires are disposed helically within said gap, with half of the wires wrapped with opposite hand to the other half.

8. A high voltage flexible cable for pressurized gas insulated transmission line service according to claim 5, wherein said tubular elements throughout their length are squeezed between said sheath and said conductor member with the roots of said sheath corrugations and the crests of said conductor member corrugations indenting said tubular elements at axially spaced intervals sufficient to accomplish said interlocking of said tubular elements with both said sheath and said conductor member.

9. A high voltage flexible cable for pressurized gas insulated transmission line service comprising in combination a continuous gas-tight cylindrical metallic conductive sheath corrugated circumferentially throughout its length, at least one elongated coextensive conductor member disposed within said sheath and having an outer surface corrugated circumferentially throughout its length, said conductor member comprising at least one corrugated tube of electrically conductive material surrounding a plurality of electrical conductor wires disposed loosely longitudinally of the cable within said corrugated tube, and a plurality of tubular elements of electrically insulating material disposed lengthwise of the cable in a transversely packed circumferential array around said conductor member between said sheath and said conductor member, said tubular elements throughout their length being squeezed radially of the cable between said sheath and said conductor member with the roots of said sheath corrugations and the crests of said conductor member corrugatons radially indenting said tubular elements at axially spaced intervals sufficient to interlock said tubular elements with both said sheath and said conductor member to resist relative longitudinal movement between said tubular elements and both said sheath and said conductor member, and said tubular elements being dimensioned in cross section and deformed radially of said cable such that adjacent tubular elements circumferentially around the conductor member are in forceful surface contact to prevent particulate migration in the cable radial direction during cable use.

* * * * *